United States Patent [19]

Stevenson

[11] 4,126,307

[45] Nov. 21, 1978

[54] PORTABLE BALLET BAR WITH ADJUSTABLE BRACING MEANS

[76] Inventor: William F. Stevenson, 13095-14A Ave., Surrey, B.C., Canada, V4A 1H9

[21] Appl. No.: 806,740

[22] Filed: Jun. 15, 1977

[30] Foreign Application Priority Data

Sep. 13, 1976 [CA] Canada ..... 261083

[51] Int. Cl.[2] ..... A63B 1/00

[52] U.S. Cl. ..... 272/62; 248/363

[58] Field of Search ..... 272/109, 62, 63, DIG. 4, 272/93, 112; 248/206 R, 363; 362/397

[56] References Cited

U.S. PATENT DOCUMENTS

| | | | |
|---|---|---|---|
| 1,142,137 | 6/1915 | Bathrick | 272/109 X |
| 2,143,783 | 1/1939 | Liebman | 248/206 R X |
| 2,200,902 | 5/1940 | Solomon | 248/206 R X |
| 2,932,510 | 4/1960 | Kravitz | 248/206 R X |
| 3,653,658 | 4/1972 | Robertson | 272/62 X |

*Primary Examiner*—Richard C. Pinkham
*Assistant Examiner*—William R. Browne
*Attorney, Agent, or Firm*—Fulwider, Patton, Rieber, Lee & Utecht

[57] ABSTRACT

A support structure for assisting an exercising dancer in maintaining her balance has vertical legs which support a horizontal rail. The legs are telescopic and adjustable as to length. Suction cups are pivotally mounted on bracing members which are adjustable lengthwise and circumferentially of the legs. The cups can be clamped to surfaces disposed at an angle to the floor on which the legs rests, or to a surface parallel to the floor, and thus lend support to the rail.

4 Claims, 4 Drawing Figures

Fig. 1.
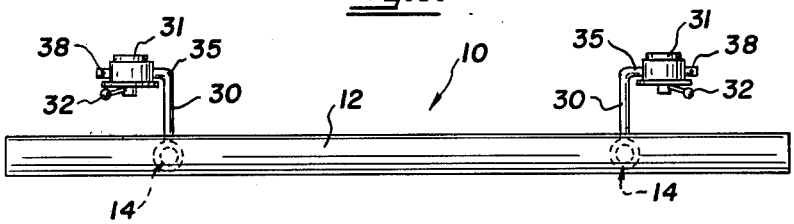
Fig. 2.
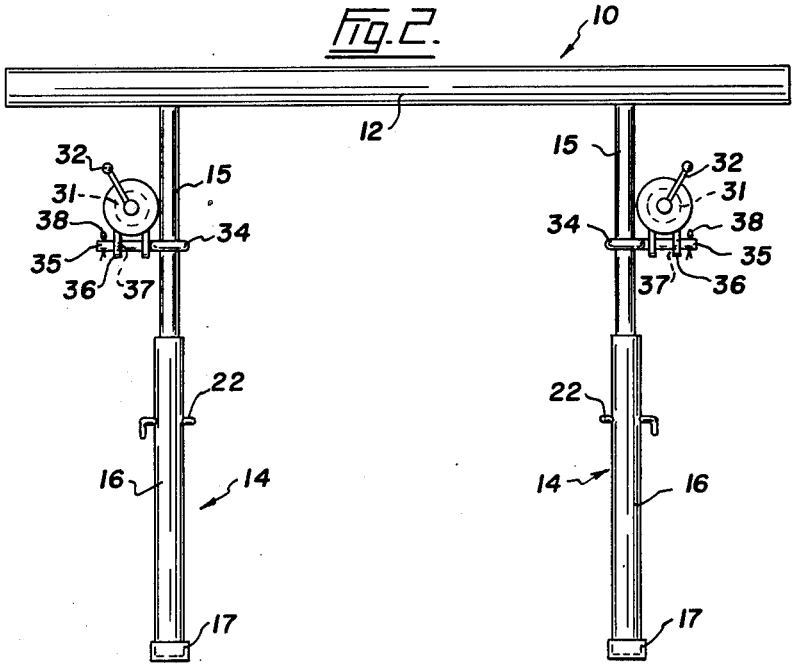
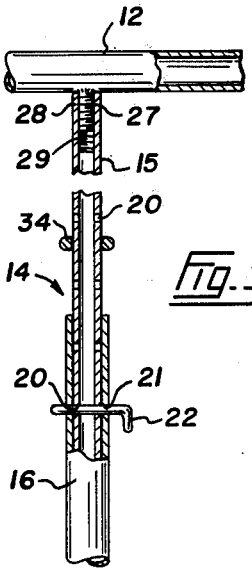
Fig. 3.
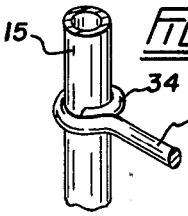
Fig. 4.

PORTABLE BALLET BAR WITH ADJUSTABLE BRACING MEANS

This invention relates generally to support structures and more particularly to a portable ballet bar.

A ballet dancer is often required to perform floor exercises where there is no balance bar permanently set up for that purpose. The obvious answer to this problem is to provide a portable or knock-down type structure which will serve the required purpose, but such structures as presently available have been found heavy and cumbersome, difficult to dismantle and reassemble, as well as being limited with regard to where they can be installed for temporary use. One such bar is disclosed in U.S. Pat. No. 2,932,510 issued on Apr. 12, 1970.

The present invention overcomes the disadvantages of known ballet bars by providing a support structure which comprises a hand rail, a pair of legs connectable to the hand rail, adjusting means for varying the effective length of the pair of legs whereby to support the rail a selected distance above a first support surface, a bracing member attachable to each of the pair of legs and adapted to project towards a second support surface, and a suction cup pivotally mounted on each bracing member for releasably engaging the second support surface.

In the drawings which illustrate a preferred embodiment of the invention;

FIG. 1 is a plan view showing a portable ballet bar constructed in accordance with the present invention, FIG. 2 is a front side elevational view of the bar, FIG. 3 is a fragmentary section, part in elevation, showing the connection between a hand rail and a leg of the bar, and FIG. 4 is a perspective view showing the connection between a bracing member of the bar and a portion of one of the legs.

Referring to the drawings, the numeral 10 indicates generally a portable ballet bar constructed in accordance with the present invention. Bar 10 is shown to comprise a hand rail 12 which preferably is formed of a metal tube about 5 feet in length.

The rail 12 is supported on a pair of elongated, upright legs indicated generally at 14. Each leg 14 has a tubular upper portion 15 preferably constructed of lightweight metal, and a similarily constructed lower portion 16 which is fitted with a foot pad 17 (FIG. 2) of a suitable anti-skid material. The telescoping portions 15 and 16 of each leg are provided with longitudinally spaced and transversely extending holes 20 and 21, see FIG. 3 only, which holes are adapted to be brought into register to receive a transverse pin 22. Thus, the pair of telescopic legs 14 can be extended and retracted as required to support the hand rail 12 a suitable distance above the floor of a room in which ballet exercises are to be performed.

The legs 14 are detachably secured to the hand rail 12 and, for this purpose, the rail is fitted with bolts 27 (FIG. 3 only) which are spaced equal distances from opposite ends of the rail. The tubular leg portions 15 have upper ends 28 which are internally threaded as indicated at 29 in FIG. 3 to receive the bolts 27 whereby to detachably secure the pair of legs to the hand rail.

The ballet bar 10 is intended to be placed on the floor usually near a wall with the hand rail extending parallel to both the floor and the wall. In order to secure the bar in this position, each leg 14 is fitted with a bracing member 30 which carries a suction cup 31. The cups 31 are of conventional design, that is, they are each fitted with an operating lever 32 which is pivotally mounted on the cup housing to be swung through a short arc. When the cups are applied to a surface and their levers 32 are actuated as described, air is evacuated from the cups so that they tightly adhere to the surface.

The bracing members 30 are each formed of a length of slightly flexible metal rod which is shaped so that inner extremity or end 34 of the rod comprises a ring as shown best in FIG. 4. The ring-like inner end 34 encircles an upper portion 15 so that the member normally is free to slide up and down on the portion as well as to rotate through 360° about the longitudinal axis of the leg. Outer extremity end 35 of the bracing member is bent at right angles as shown best in FIG. 1. The suction cups 31 each have outwardly projecting brackets 36 (FIG. 2) which are provided with aligned openings 37 and the outer end 35 of a bracing member 30 is received in these openings to pivotally mount the suction cup. Cotter pins 38 extend through the ends 35 to prevent separation of the suction cups from the members 30.

The suction cups 31 are attached to the wall in the usual manner, viz, they are applied to the wall surface and their levers 32 are then actuated so that the cups grip the wall. The inner ends 34 of the bracing members are then pushed either up or down on the legs portions 4 to wedge the rings thereon and to take up any slack motion between the cups and the legs. When this is done, the portable ballet bar is firmly secured to the wall with the hand rail positioned a distance from the floor determined by where the pins 22 are set in the leg portions.

It is a simple matter to detach the bar 10 from the wall and dismantle it for shipment or storage. This is done by swinging the levers 32 to release the suction and detach the cups. The legs 14 are then unscrewed from the hand rail 12 and the bracing members 30 are slid off the upper portions 15 of the legs. This dismantling reduces the structure to five major parts which can be placed side by side and secured together in some suitable manner for storage or shipment.

From the foregoing, it will be apparent the portable ballet bar is a lightweight and sturdy structure which is particularly well suited for use by travelling dance companies and the like. The dismantled bar makes a compact bundle which can be unpacked and readily set up in hotel rooms and elsewhere for short exercise sessions by the dancers. The suction cups are attachable to most wall surfaces as above described but can just as easily be clamped to an inclined surface or to a horizontal surface such as a counter top or window ledge.

I claim:

1. A support structure comprising:

a hand rail;

a pair of upright legs connectable to said hand rail to support said rail above a first support surface;

a pair of bracing members carried by said pair of legs, respectively, each of said bracing members including an inner extremity means and an outer extremity means, said inner extremity means being rotatable about and adjustably movable along the length of the associated one of said pair of legs whereby said inner extremity means is adapted for in the direction of any one of a variety of second positioning so as to orient said outer extremity means support surfaces located at different distances and angular orientations relative to a first support surface; and a suction cup pivotally mounted on each of said bracing members for releasably engaging the selected second support surface whereby said pair of bracing members provide constraint against lateral tipping of said pair of legs.

2. A support structure comprising: a horizontal hand rail;

a pair of elongated, upright legs connectable to said hand rail to support said hand rail a suitable distance above a floor;

a pair of bracing members associated with said pair of legs, respectively, each having an inner extremity and an outer extremity, each said inner extremity being formed into a ring means for encircling the associated one of said legs; and a suction cup pivotally secured to said outer extremity of each said bracing member for releasably engaging a wall or other support surface, said ring means of each of said pair of bracing members being longitudinally slidable along the length of the associated one of said pair of legs whereby, upon engagement of said wall by each said suction cup, longitudinal slidable movement of each said ring means tends to wedge each said ring means against the associated one of said legs and prevent further relative movement therebetween in any direction.

3. A support structure as claimed in claim 2, in which said hand rail has longitudinally spaced threaded members, and each of said pair of legs has a correspondingly threaded upper end for engaging one of said threaded members.

4. A support structure as claimed in claim 2, in which the lower end of each of said pair of legs is fitted with an anti-skid pad.

* * * * *

UNITED STATES PATENT AND TRADEMARK OFFICE

CERTIFICATE OF CORRECTION

PATENT NO. : 4,126,307

DATED : November 21, 1978

INVENTOR(S) : STEVENSON

It is certified that error appears in the above-identified patent and that said Letters Patent are hereby corrected as shown below:

Column 2, line 14, after "extremity" insert --or--.

Claim 1, Column 2, line 63, after "for" delete "in the direction of any one of a variety of second";

Claim 1, Column 2, line 65, after "means" insert --in the direction of any one of a variety of second--.

Signed and Sealed this

*Fifth* Day of *June 1979*

[SEAL]

*Attest:*

RUTH C. MASON
*Attesting Officer*

DONALD W. BANNER
*Commissioner of Patents and Trademarks*